US008279214B2

(12) United States Patent
Correa et al.

(10) Patent No.: US 8,279,214 B2
(45) Date of Patent: Oct. 2, 2012

(54) METHOD AND APPARATUS FOR POWER LEVEL CONTROL OF A DISPLAY DEVICE

(75) Inventors: Carlos Correa, Villingen-Schwenningen (DE); Cédric Thebault, Villingen-Schwenningen (DE); Rainer Zwing, VS-Villingen (DE)

(73) Assignee: Thomson Licensing, Boulogne-Billancourt (FR)

( * ) Notice: Subject to any disclaimer, the term of this patent is extended or adjusted under 35 U.S.C. 154(b) by 1684 days.

(21) Appl. No.: 11/595,294

(22) Filed: Nov. 9, 2006

(65) Prior Publication Data

US 2007/0103399 A1 May 10, 2007

(30) Foreign Application Priority Data

Nov. 10, 2005 (EP) ..... 05292386

(51) Int. Cl.
*G09G 5/00* (2006.01)

(52) U.S. Cl. ..... 345/212

(58) Field of Classification Search ..... 345/212, 345/690, 163, 60
See application file for complete search history.

(56) References Cited

U.S. PATENT DOCUMENTS 6,380,943 B1 4/2002 Morita et al.
6,496,165 B1 12/2002 Ide et al.
7,133,027 B2 * 11/2006 Kimura ..... 345/163
2003/0173903 A1 * 9/2003 Takeuchi et al. ..... 315/169.2
2003/0234753 A1 * 12/2003 Tanaka ..... 345/67
2005/0007314 A1 * 1/2005 Kang ..... 345/63
2007/0115303 A1 * 5/2007 Aoki et al. ..... 345/690

FOREIGN PATENT DOCUMENTS

EP 1 026 655 A 8/2000

OTHER PUBLICATIONS

European Search Report dated Apr. 24, 2006.

* cited by examiner

*Primary Examiner* — William Boddie
*Assistant Examiner* — Leonid Shapiro
(74) *Attorney, Agent, or Firm* — Tutunjian & Bitetto, P.C.

(57) ABSTRACT

The invention concerns a video processing for improving the picture quality of picture which are displayed on display devices like plasma display panels and all kind of display devices based on the principle of duty cycle modulation of light emission and for reducing the average power dissipation. The basic idea behind the invention is to generate only the required amount of sustain pulses that effectively produce light and to avoid generating unnecessary sustain pulses. To this end, the video range of the input video is increased in order to be equal to a nominal range, 255 in the case of a 8-bit coding, and a power level mode with a reduced number of sustain pulses is selected to keep constant the brightness of the image. The number of sustain pulses that do not produce light is reduced.

5 Claims, 4 Drawing Sheets

METHOD AND APPARATUS FOR POWER LEVEL CONTROL OF A DISPLAY DEVICE

This application claims the benefit, under 35 U.S.C. §119 of European Patent Application 05292386.9 filed Nov. 10, 2005.

FIELD OF THE INVENTION

The invention relates to a method for power level control of a display device and an apparatus for carrying out the method.

More specifically the invention is closely related to a kind of video processing for improving the picture quality of picture which are displayed on display devices like plasma display panels (PDP) and all kind of display devices based on the principle of duty cycle modulation (pulse width modulation) of light emission. The invention is also used for reducing the average power dissipation in the plasma display panels.

BACKGROUND OF THE INVENTION

Today, the Plasma technology makes possible to achieve flat colour panel of large size (out of the CRT limitations) and with very limited depth without any viewing angle constraints. Like CRT (Cathode Ray Tube) technology, PDP is a technology that generates its own light. In the same way, both technologies use a power management (or brightness regulation) circuit which allows a higher peak white brightness value than a full white value.

The CRT screens use a so called ABL (for Average Beam-current Limiter) circuit, which is implemented by analog means usually in the video controller, and which decreases video gain as a function of average luminance usually measured over an RC stage.

The plasma display panels use a so called APL (for Average Power Level) control circuit that generates less or more sustain pulses as a function of the average power level of the displayed picture. The APL control starts from the reflection that for larger peak white luminance values in plasma displays more sustain pulses are necessarily required. On the other hand, more sustain pulses correspond also to a higher power consumption of the PDP. Thus the solution is a control method which generates more or less sustain pulses as a function of the average picture power, i.e. it switches between different modes with different power levels. Such an APL control circuit is described in the international patent application WO 00/46782. For pictures having relatively low picture power, i.e. a lot of pixels with relatively low luminance value, a mode will be selected which uses a high number of sustain pulses to create the different video levels because the overall power consumption will be limited due to a great amount of pixels with low luminance value. For pictures having relatively high picture power, i.e. a lot of pixels with relatively high luminance value, a mode will be selected which uses a low number of sustain pulses to create the different video levels because the overall power consumption will be high due to a great amount of pixels with high luminance value. Thus, a plurality of power level modes can be defined for a good management of the power consumption.

The APL control is implemented as follows: first the average video level of the input signal after de-gamma is computed. This value is a good estimation of the total luminance power required for reproducing the input picture. Secondly, by means of a look-up table, the total number of sustain pulses that can be generated for the input picture to keep the power consumption in an authorized range is determined and a corresponding subfield organisation is simultaneously selected.

As described in the international patent application WO 00/46782, the sub-field organisations can vary in respect to one or more of the following characteristics:

the number of sustain pulses;

the number of sub-fields;

the sub-field positioning.

As mentioned before, this APL control circuit allows a higher peak-white value without overloading the set power supply. However, this solution is not optimal in some operation conditions. For example, if the PDP is connected to a video source where the video range is inferior to the nominal range (for instance if the input video range is 0 to 160 and the nominal range is 255 for an 8-bit range), there are some video levels that are never used and some supply power is so wasted in generating sustain pulses that produce no light. Indeed, as the sustain pulses are generated simultaneously for the whole panel, even if a subfield is never used, it consumes energy.

SUMMARY OF THE INVENTION

It is an object of the present invention to disclose a new method and apparatus for power level control which reduces the average power consumption when the video range is inferior to the nominal range.

The basic idea behind the new power level control method is to generate only the required amount of sustain pulses that effectively produce light and to avoid generating unnecessary sustain pulses. To this end, the video range of the input video is increased in order to be equal to the nominal range and a power level mode with a reduced number of sustain pulses is selected to keep constant the brightness of the image. To increase the video range of the picture, a video gain is applied to the video levels of the picture.

The inventive method is a method for power level control in a display device having a plurality of luminous elements corresponding to the pixels of a picture, wherein the time duration of a video frame is divided into a plurality of subfields during which each luminous element can be activated for light emission in small pulses, called hereinafter sustain pulses, corresponding to a subfield code word representative of the video level of the corresponding pixel, wherein a set of power level modes is provided for subfield coding wherein to each power level mode a characteristic subfield organization belongs, the subfield organizations being variable in respect to the number of sustain pulses during a frame. The inventive method comprises

- a step for determining a power value which is characteristic for the power level of the picture to be displayed and a maximum video value which is characteristic for the maximum video level of said picture, and
- a step for increasing said maximum video value to substantially a nominal value and a step for selecting a power level mode based on said power value and said maximum video value, said power level mode having a reduced number of sustain pulses such that that the light emission of each pixel is kept.

The maximum video value of the picture is increased to the nominal value by applying a gain to the video levels of the picture to be displayed.

Preferably, the power value of a picture is for example the average power value of said picture.

Advantageously, the power value is a smoothed value of the power values of a plurality of pictures and/or the maximum video value is also a smoothed value of the maximum video values of said plurality of pictures.

The invention consists further in an apparatus for power level control in a display device having a plurality of luminous elements corresponding to the pixels of a picture, wherein the time duration of a video frame is divided into a plurality of subfields during which each luminous element can be activated for light emission in small pulses, called hereinafter sustain pulses, corresponding to a subfield code word representative of the video level of the corresponding pixel, wherein a set of power level modes is provided for subfield coding wherein to each power level mode a characteristic subfield organization belongs, the subfield organizations being variable in respect to the number of sustain pulses during a frame. The apparatus comprises

- an average picture power circuit for determining a power value which is characteristic for the power level of the picture to be displayed,
- a maximum video value circuit for determining a maximum video value which is characteristic of the maximum video level of the picture to be displayed,
- a power level control circuit for increasing said maximum video value to a nominal value and for selecting a power level mode based on said power value and said maximum video value, said power level mode having a reduced number of sustain pulses such that that the light emission of each pixel is kept.

In a preferred embodiment, the power level control circuit comprises a circuit for smoothing the power values and the maximum video values of a plurality of pictures and a mode selection circuit for selecting a power level mode based on said smoothed power value and maximum video value and a gain value based on said smoothed maximum video value.

In a preferred embodiment, the mode selection circuit comprises

- a first circuit for transforming the power value of the picture to be displayed into a first number of sustain pulses,
- a second circuit for transforming the maximum video value into a gain value to be applied to the video levels of said picture,
- a third circuit for multiplying said first number of sustain pulses by the ratio of said maximum video value to the nominal value; said circuit delivering a second number of sustain pulses and
- a fourth circuit for transforming said second number of sustain pulses into a power level mode. The first, second and fourth circuits are for example look-up tables.

BRIEF DESCRIPTION OF THE DRAWINGS

Exemplary embodiments of the invention are illustrated in the drawings and are explained in more detail in the following description. In the drawings.

DESCRIPTION OF PREFERRED EMBODIMENTS

Figure 1:
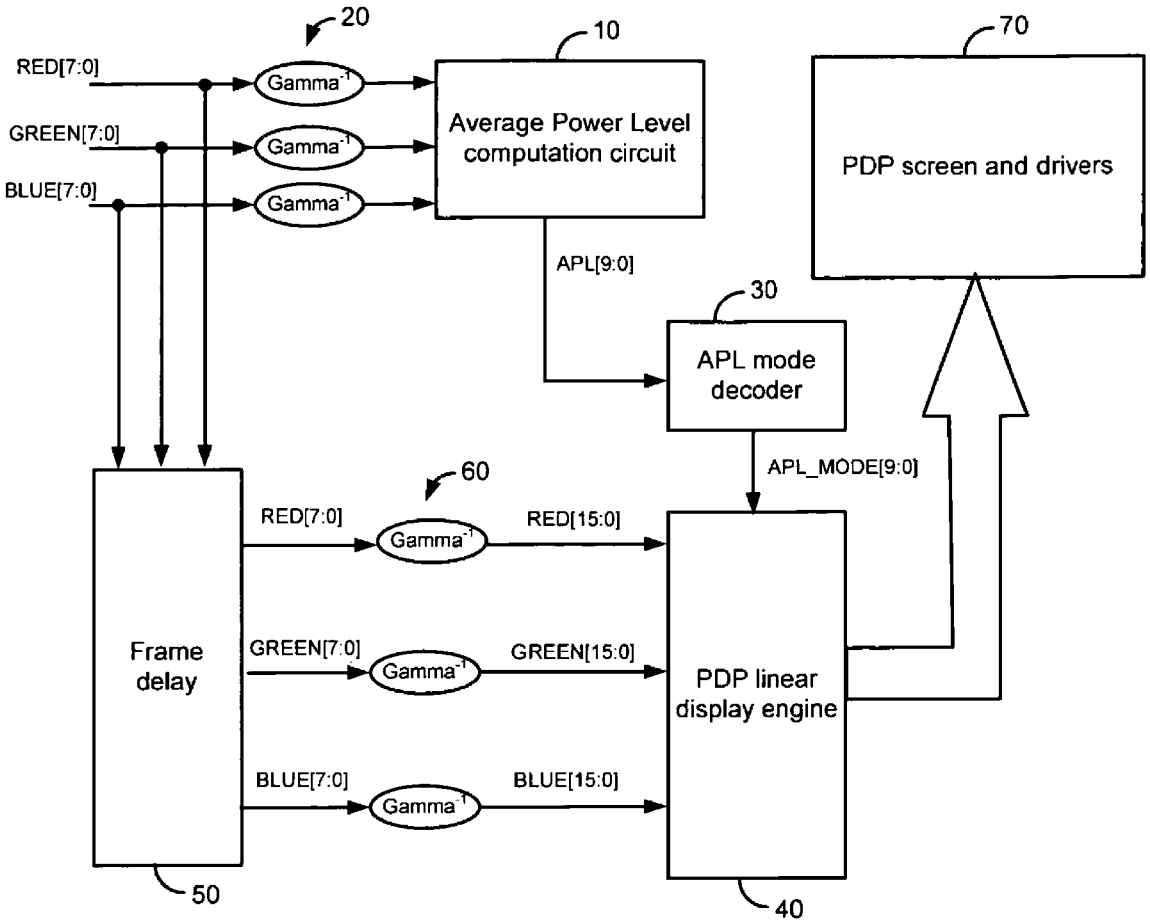
FIG.1 (PRIOR ART)
FIG. 1 shows a block diagram of a power level control device of a Plasma display Panel of the prior art.

FIG. 1 shows a block diagram of a power level control device of a Plasma display Panel of the prior art. As mentioned before, the principle implemented by this device is to compute the average power of a given picture and to select an appropriate power level mode (corresponding to a subfield organization) for sub-field coding.

In reference to FIG. 1, the input video signals RED[7:0], GREEN[7:0], BLUE[7:0] are provided to an Average Power Level computation circuit 10 after a de-gamma processing 20. The APL computation circuit 10 outputs a 10-bit APL signal, called APL[9:0], that is representative of the total luminance power required for displaying the input picture. The average power value APL[9:0] of a picture can be calculated by simply summing up the pixel values for all video input data and dividing the result through the number of pixel values multiplied by three. The signal APL[9:0] is then used by an APL mode decoder 30 for converting it into a power level mode, called APL_MODE[9:0], representing a subfield organization. In practice, the APL mode decoder 30 is a simple Look Up Table. Different examples of power level modes are given here:

Mode 204:204 sustain pulses full white)
Mode 205:205 sustain pulses
. . .
Mode 700:700 sustain pulses
Mode 1000:1000 sustain pulses For clarity reasons, the number of sustain pulses of a power level mode given in this example is identical to the mode number. The sustain pulses are distributed among the different subfields of the video frame. This distribution is not described because it does not have consequences on the power consumption.

The input video signals RED[7:0], GREEN[7:0], BLUE[7:0] are also provided to a PDP display engine 40 after being delayed by a frame delay circuit 50 and a de-gamma processing 60. Indeed input video signals have to be de-gammed by because the PDP display engine 40 has a linear gamma transfer function (the displayed brightness is proportional to number of generated sustain pulses). They also have to be delayed from a frame duration in order that the power level mode APL_MODE[9:0] determined by the decoder 30 corresponds to the video data supplied to the PDP display engine 40.

So the linear display engine 40 receives three 16-bit de-gammed input video signals RED[15:0], GREEN[15:0], BLUE[15:0] and the 10-bit APL mode value APL_MODE[9:0] that controls the number of sustain pulses to be generated. The subfield organization selected by the signal APL_MODE [9:0] is used by the display engine 40 for coding the video signals RED[15:0], GREEN[15:0], BLUE[15:0] and the signals outputted by the display engine 40 are then provided to the PDP drivers 70 for displaying the corresponding images.

As mentioned before, this device does not take into account the fact that when the video range of the input video is reduced, some supply power is wasted for generating sustain pulses that do not produce light. According to the invention, the video range of the input video is increased in order to be equal to the nominal range (255 for a 8-bit coding) and a power level mode with a reduced number of sustain pulses is selected to keep constant the brightness of the image. To increase the video range of the picture, a video gain is applied to the video levels of the picture.

Figure 2:
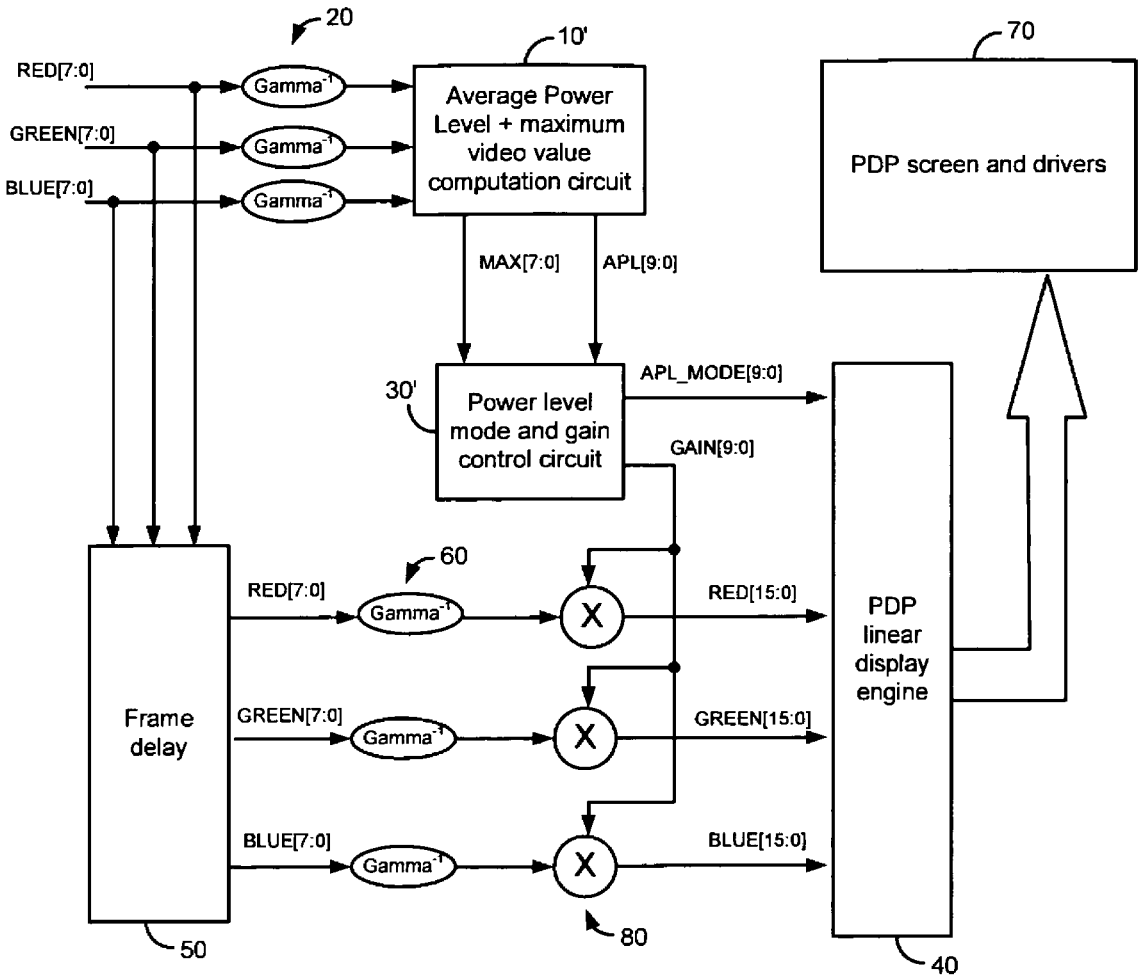
FIG. 2 shows a block diagram of a power level control device of a Plasma display Panel according to the invention.

For implementing the invention, the device of FIG. 1 has been modified. FIG. 2 shows a block diagram of a power level control device of a Plasma display Panel according to the invention. The same reference signs are used in two figures for the identical circuit blocks.

In reference to FIG. 2, the input video signals RED[7:0], GREEN[7:0], BLUE[7:0] are first provided de-gamma circuits 20 and then to a circuit 10' for computing the average power level APL[9:0] of the input video image and for determining the maximum video value MAX[7:0] of said image. These two signals APL[9:0] and MAX[7:0] are then converted by a power control mode and gain control circuit 30' into a power level mode APL_MODE[9:0] representing a subfield organization and a gain value GAIN[9:0] to be applied to the video input. The power level mode APL_MODE[9:0] is selected as a function of the two signals APL[9:0] and MAX[7:0] and the gain value GAIN[9:0] is selected as a function of the maximum value MAX[7:0]. An example of power level mode and gain value will be given in reference to FIG. 4.

Otherwise, the input video signals RED[7:0], GREEN[7:0], BLUE[7:0] that are used by the PDP display engine 40 for displaying the picture are first delayed by a frame delay circuit 50, de-gammed by de-gamma circuits 60 and amplified by the selected gain value GAIN[9:0] by means of multiplier circuits 80. So the linear display engine 40 receives three 16-bit amplified input video signals RED[15:0], GREEN[15:0], BLUE[15:0] and the power level mode value APL_MODE[9:0] that controls the number of sustain pulses to be generated. The subfield organization selected by the signal APL_MODE[9:0] is used by the display engine 40 for coding the amplified video signals RED[15:0], GREEN[15:0], BLUE[15:0] and the signals outputted by the display engine 40 are provided to the PDP drivers 70 for displaying the corresponding images.

Figure 3:
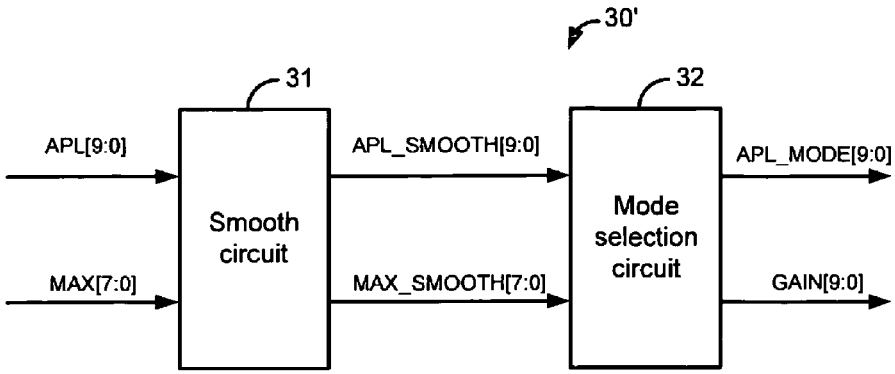
FIG. 3 shows a block diagram of a power level mode and gain control circuit of the device of FIG. 2.

FIG. 3 shows a possible block diagram of the power level mode and gain control circuit 30' of the device of FIG. 2. It comprises 2 series-connected sub-circuits:

- a smooth circuit 31 for eliminating noise and oscillations on the computed values APL[9:0] and MAX [7:0], and
- a mode selection circuit 32 for implementing the inventive method, i.e., if video range is lower than a maximum value (for instance 255 for a 8-bit range), then the number of sustain pulses is reduced at the same time that the video levels are increased.

Figure 4:
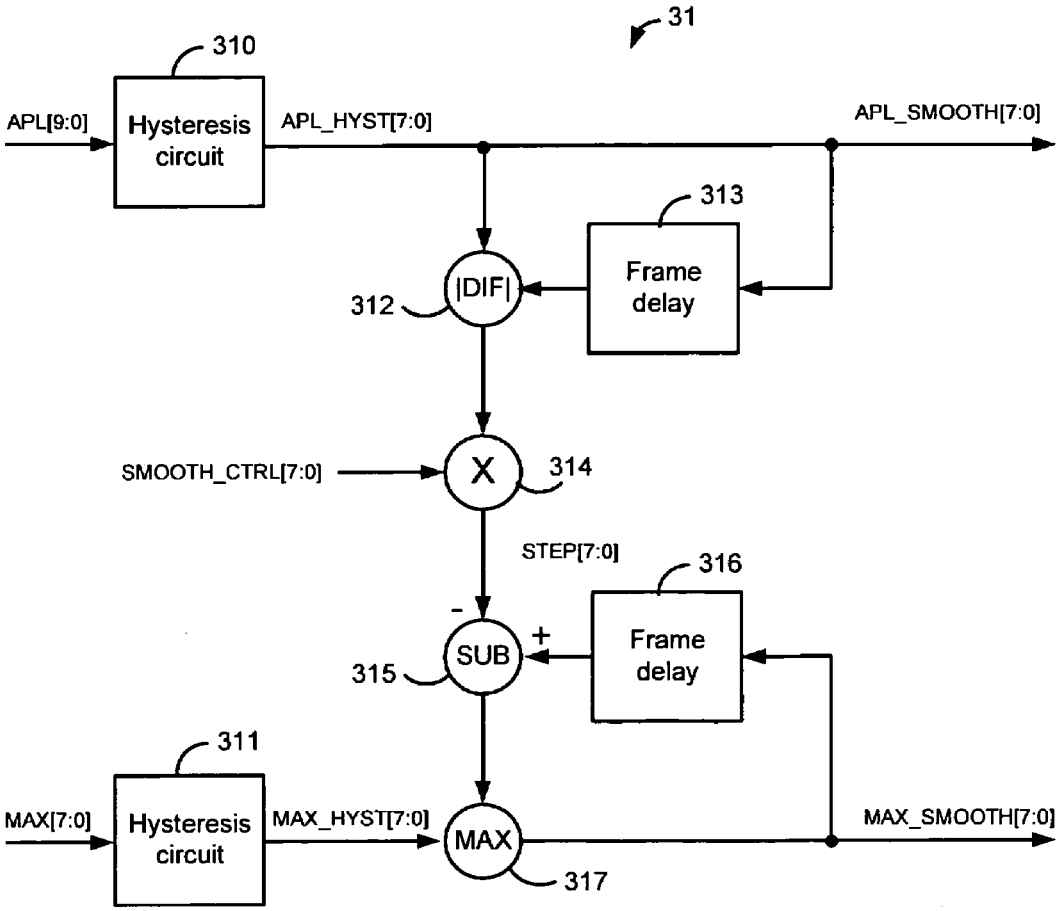
FIG. 4 shows a block diagram of a smooth circuit of the device of FIG. 3.

FIG. 4 shows a possible block diagram of the smooth circuit 31. It receives the signals APL[9:0] and MAX [7:0] and outputs signals APL_SMOOTH[9:0] and MAX_SMOOTH[7:0].

Figure 6:
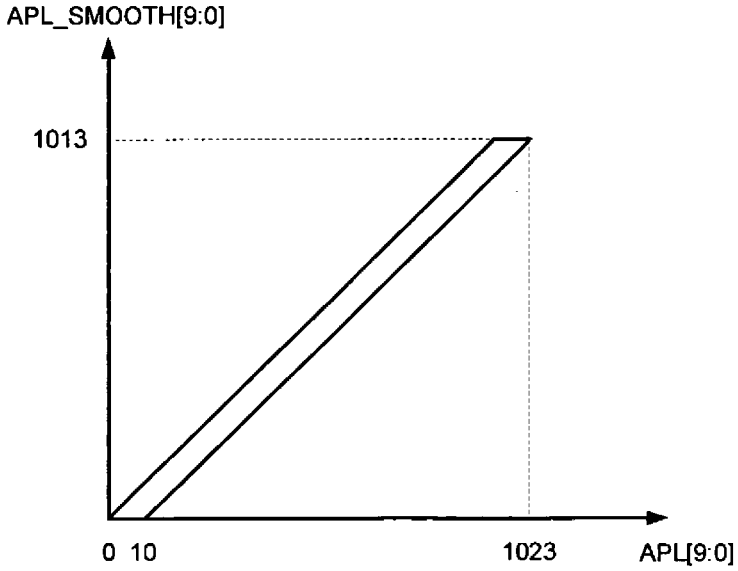
FIG. 6 illustrates the behavior of an hysteresis circuit of the smooth circuit of FIG. 4.

In reference to FIG. 4, the signal APL[9:0] is processed by a hysteresis circuit 310 whose behavior is shown at FIG. 6 for generating the smoothed signal APL_SMOOTH[9:0].

For generating the smoothed signal MAX_SMOOTH[7:0], a simple hysteresis circuit 311 is not sufficient. The reason for this is that a slight modification of the displayed picture can be enough for dramatically modifying the value MAX[7:0] of displayed picture. An example of this is what happens when a small flashing white caption is displayed on a rather dark picture. If no precautions were taken, the power level control device would in this case flash between two quite different power level modes.

The principle of the smoothing principle on value MAX[7:0] is the following:

- If the value MAX[7:0] is increasing no smoothing is applied. If this were not the case, the maximum video value would be higher than the measured value, which means that the video input range would exceed the measured range, and most probably there would be part of the picture that would be clipped above.
- If MAX[7:0] value is decreasing, smoothing is applied. The top half part of the circuit 31 evaluates a value STEP[7:0] which is a function of a APL frame difference which is the difference between two consecutive values APL_SMOOTH[9:0] of to two consecutive frames. Said APL frame difference is calculated by a difference circuit 312 and a frame delay 313 is required. In this figure, STEP[7:0] is evaluated by multiplying the APL frame difference by a control value SMOOTH_CTRL[7:0] by the means of a multiplier circuit 314. If SMOOTH_CTRL[7:0] is small, STEP[7:0] will be small and the circuit 31 will perform maximum smoothing. If SMOOTH_CTRL[7:0] is high, STEP[7:0] will also be high, and the circuit 31 will perform little or no smoothing effect. STEP[7:0] represents the maximum allowed negative discontinuity on the smoothed value MAX_SMOOTH[7:0] over a frame. The bottom half part of the circuit prevents that between two frames, the value MAX_SMOOTH[7:0] sinks by a value higher than this previously evaluated STEP[7:0] value.

Figure 5:
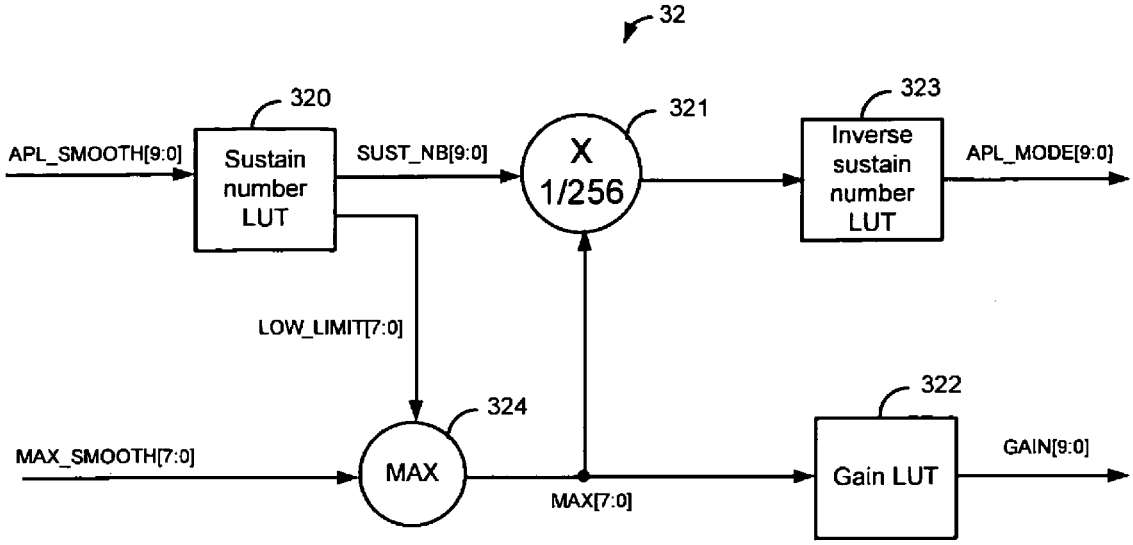
FIG. 5 shows a block diagram of a mode selection circuit of the device of FIG. 3.

FIG. 5 shows a possible implementation of the mode selection circuit 32. It comprises a first LUT 320 which receives the value APL_SMOOTH[9:0] coming from the smooth circuit 31 and outputs a number of the sustain pulses corresponding to said value APL_SMOOTH[9:0]. This number of sustain pulses is then multiplied by the value MAX_SMOOTH [7:0] divided by 256 by means of a multiplier circuit 321. The value MAX_SMOOTH [7:0] is then converted by a gain Look Up Table 322 into the gain value GAIN[9:0] to be applied to the video levels of the pictures. For a maximum video level of x, the gain is equal to 255/x. The number of sustain pulses outputted by the multiplier 321 is converted back into an APL value APL_MODE[9:0] that is representative of a power level mode by means of a LUT 323 that has a function inverse to the LUT 320

Preferably, the mode selection 32 comprises means 324 for selecting the maximum value between the value MAX_SMOOTH [7:0] and a low limit value LOW_LIMIT [7:0] in order that the number of sustain pulses outputted by the multiplier 321 is equal to or greater than the lowest number of sustain pulses of the different power level modes i.e the mode corresponding to the full-white mode. This value LOW_LIMIT [7:0] is depending on the number of sustain pulses outputted by the LUT 320. In the example of FIG. 5, this value is also outputted by the LUT 320.

An example will help to clarify the meaning of the different signals mentioned above. In this example, the minimum amount of sustain pulses is 200. A factor F is given. It is just a calculation factor and denotes the lowest multiplication factor that does not produce a final number of sustain pulses inferior to 200.

| SUST_NB[9:0] | F = 200/ SUST_NB[9:0] | LOW_LIMIT[7:0] = F * 256 |
|---|---|---|
| 200 | 1.00 | 256 |
| 300 | 0.67 | 172 |
| 400 | 0.50 | 128 |
| 500 | 0.40 | 103 |
| 600 | 0.34 | 88 |
| 700 | 0.29 | 75 |
| 800 | 0.25 | 64 |
| 900 | Not used | 64 |
| 1000 | Not used | 64 |

For noise sensitivity reasons, the LOW_LIMIT[7:0] value is clamped on above look-up table to 64, but this is not mandatory. Thus, if the minimum value of MAX[7:0] is 64, the maximum value of the video gain GAIN[9:0] is 255*1/64 which is approximately 4.

Let us explain the functioning of the mode selection 32 by an example. Let us suppose that input video has an input range 0-128 that is a subset of the range 0-255 in the case of 8-bit coding. If the value APL_SMOOTH[9:0] corresponds to a power level mode with 534 sustain pulses, the value 534 is outputted by the LUT 320. This value is multiplied by 128/256 by the multiplier 321. Then the number of sustain pulses outputted by the multiplier 321 is 267 and the video gain is approximately 2. This factor 2 will map the input video range back to 0-to-255 as desired. The number of sustain pulses 267 is then converted back into an APL value APL_MODE[9:0] by the LUT 323. This value APL_MODE[9:0] will be used by the PDP display engine 40 for coding the amplified video levels of the picture with a power level mode having a total number of sustain pulses of 267.

On a realistic application, the gain range might go from 1 (no amplification) up to a maximum of about 4. Indeed, the gain should never be higher than the ratio between peak white value and full white value.

The invention presented here is an extension to the classical PDP power management circuit which

- improves the picture quality because on average, the number of discrete video levels available for coding the video input is higher; and
- considerably reduces the PDP average power dissipation by eliminating generating unnecessary sustain pulses that do not directly translate into produced output light. This is in particular true for pictures with a low average power.

The blocks shown in all the figures can be implemented with appropriate computer programs rather than with hardware components.

The invention is not restricted to the disclosed embodiments.

Various modifications are possible and are considered to fall within the scope of the claims. e.g. a set of other power level modes can be used instead of the ones given here, other smooth circuits or no smooth circuit can be used, video ranges for other codings than a 8-bit coding can be used, . . . .

The invention can be used for all kinds of displays which are controlled by using a PWM like control of the light emission for grey-level variation.

The invention claimed is:

1. Apparatus for power level control in a display device having a plurality of luminous elements corresponding to the pixels of a picture, wherein the time duration of a video frame is divided into a plurality of subfields during which each luminous element can be activated for light emission in small pulses, called hereinafter sustain pulses, corresponding to a subfield code word representative of the video level of the corresponding pixel, wherein a set of power level modes is provided for subfield coding wherein to each power level mode a characteristic subfield organization belongs, the subfield organizations being variable in respect to the number of sustain pulses during a frame, said apparatus comprising

- a first circuit for transforming the power value of the picture to be displayed into a first number of sustain pulses,
- a second circuit for transforming the maximum video value into a gain value to be applied to the video levels of said picture,
- a third circuit for multiplying said first number of sustain pulses by the ratio of said maximum video value to a nominal value and delivering a second number of sustain pulses and
- a fourth circuit for transforming said second number of sustain pulses into a power level mode having a reduced number of sustain pulses such that the light emission of each pixel is kept the same.

2. Apparatus according to claim 1, wherein the power level control apparatus comprises a circuit for smoothing the power values and the maximum video values of a plurality of pictures and a mode selection circuit for selecting a power level mode based on said smoothed power value and maximum video value and a gain value based on said smoothed maximum video value.

3. Apparatus according to claim 1, wherein the power level control apparatus comprises a mode selection circuit for selecting a power level mode based on the power value and the maximum video value and a gain value based on said maximum video value.

4. Apparatus according to claim 1, wherein the first, second and fourth circuits are look-up tables.

5. Apparatus according to claim 1, wherein it is included in a display device, in particular a plasma display device.

* * * * *